US009255770B1

(12) United States Patent
DiCorte

(10) Patent No.: US 9,255,770 B1
(45) Date of Patent: Feb. 9, 2016

(54) ILLUMINATION FOR TELESCOPIC SIGHT

(71) Applicant: Mark DiCorte, Waco, TX (US)

(72) Inventor: Mark DiCorte, Waco, TX (US)

( * ) Notice: Subject to any disclaimer, the term of this patent is extended or adjusted under 35 U.S.C. 154(b) by 0 days.

(21) Appl. No.: 14/479,930

(22) Filed: Sep. 8, 2014

Related U.S. Application Data

(60) Provisional application No. 61/935,559, filed on Feb. 4, 2014.

(51) Int. Cl.
*F41G 1/34* (2006.01)

(52) U.S. Cl.
CPC ..... *F41G 1/345* (2013.01)

(58) Field of Classification Search
CPC ..... F41G 1/17; F41G 1/16; F41G 1/34; F41G 1/345
USPC ..... 42/90, 114–116, 119, 123, 131, 132
See application file for complete search history.

(56) References Cited

U.S. PATENT DOCUMENTS

| | | | | |
|---|---|---|---|---|
| 1,728,993 | A * | 9/1929 | Gerdes | 359/399 |
| 2,357,542 | A * | 9/1944 | Pfeil | 353/42 |
| 2,769,895 | A | 11/1956 | Boord | |
| 4,542,447 | A | 9/1985 | Quakenbush | |
| 4,627,171 | A | 12/1986 | Dudney | |
| 5,040,885 | A * | 8/1991 | Simms | 359/399 |
| 6,449,419 | B1 * | 9/2002 | Brough et al. | 385/136 |
| 6,499,247 | B1 * | 12/2002 | Peterson | 42/116 |
| 7,648,291 | B2 * | 1/2010 | Laganas et al. | 396/530 |
| 7,870,688 | B1 * | 1/2011 | Dasiukevich | 42/124 |
| 7,913,439 | B2 | 3/2011 | Whaley | |
| 8,312,668 | B2 | 11/2012 | Kincel | |
| 8,327,573 | B1 | 12/2012 | Cheng et al. | |
| 8,327,574 | B2 | 12/2012 | Sandler et al. | |
| 2003/0086165 | A1 | 5/2003 | Cross et al. | |
| 2012/0180368 | A1 | 7/2012 | Haley et al. | |
| 2012/0255213 | A1 | 10/2012 | Panos | |
| 2013/0283661 | A1 * | 10/2013 | Lynn et al. | 42/114 |

* cited by examiner

*Primary Examiner* — Reginald Tillman, Jr.
(74) *Attorney, Agent, or Firm* — Robert C Montgomery; Montgomery Patent & Design, LLC

(57) ABSTRACT

An illuminating device includes a clamp tube including an open front end and an opposed open rear end and defining an inner cavity extending from the front end to the rear end. A light assembly is receivably connected to the clamp tube at the rear end. The clamp tube is configured to receivably connect to an eyepiece of a scope of a firearm at the front end. The light assembly projects illumination through the inner cavity and through the scope.

15 Claims, 3 Drawing Sheets

ILLUMINATION FOR TELESCOPIC SIGHT

RELATED APPLICATIONS

The present invention was first described in and claims the benefit of U.S. Provisional Application No. 61/935,559, filed Feb. 4, 2014, the entire disclosures of which are incorporated herein by reference.

FIELD OF THE INVENTION

The present invention relates generally to firearms and, more particularly, to an illumination device operatively connected to a telescopic sight of a firearm.

BACKGROUND OF THE INVENTION

Over the years, modern advances in hunting equipment have enhanced the sport, providing hunters with increased success. Among these products, optical scopes or telescopic sights used on high-powered rifles and pistols offers long-range targeting capabilities with pinpoint accuracy.

However, such devices, despite their high technology appearance, are still sighted in using a trial and error process not unlike that used for iron sights made over a century ago. Additionally, an accurate setup requires a controlled scenario that is properly illuminated. Additionally, the field of hunting equipment and accessories is highly competitive and highly profitable, meaning that manufacturers are on the constant lookout for the next "big thing" that adds a competitive edge to their product lineup.

Accordingly, there exists a need for a means by which optical scopes used on firearms can be utilized in a more accurate and easy to use manner.

SUMMARY OF THE INVENTION

The inventor has recognized the aforementioned inherent problems and lack in the art and observed that there is a need for a device configured to be utilized with a telescopic sight of a firearm to project an illuminated image of a crosshair of the scope onto a target. The development of the present invention, which will be described in greater detail herein, substantially departs from conventional solutions to fulfill this need.

In one (1) embodiment, the disclosed illuminating device includes a clamp tube including an open front end and an opposed open rear end and defining an inner cavity extending from the front end to the rear end. A light assembly is receivably connected to the clamp tube at the rear end. The clamp tube is configured to receivably connect to an eyepiece of a scope of a firearm at the front end. The light assembly projects illumination through the inner cavity and through the scope.

In another embodiment, the disclosed illuminating device includes a clamp tube including an open front end and an opposed open rear end and defining an inner cavity extending from the front end to the rear end. A light assembly is receivably connected to the clamp tube at the rear end. A scope for a firearm is receivably connected to the clamp tube at the front end. The light assembly projects illumination through the inner cavity and through the scope to form an illuminated image on a target.

In yet another embodiment, the disclosed illuminating device includes a cylindrical clamp tube including a cylindrical open front end, an opposed cylindrical open rear end, a cylindrical inner cavity defined from the front end to the rear end, a plurality of front compression fingers extending outwardly from the open front end, the plurality of front compression fingers being parallel to one another and equally spaced apart, a plurality of rear compression fingers extending outwardly from the open rear end, the plurality of rear compression fingers being parallel to one another and equally spaced apart, a first threaded region disposed on an exterior of the clamp tube at the plurality of front compression fingers, and a third threaded region disposed on an exterior of the plurality of rear compression fingers, the plurality of rear compression fingers and the open front end being configured to receive an eyepiece of a scope of a firearm. The device includes a light assembly connected to the clamp tube. The light assembly includes a body including a front end received through the rear end of the clamp tube and an opposed rear end, a conical reflector disposed at the front end of the body, a lamp positioned within the conical reflector, a power source disposed within the body, and a switching cap connected to the rear end of the body to provide electrical communication between the lamp and the power source. The device includes a front collar removably connected to the front end of the clamp tube to secure the scope to the clamp tube within the open front end of the clamp tube. The front collar includes a second threaded region disposed on an interior surface to threadingly engage the first threaded region of the clamp tube and inwardly clamp the plurality of front compression fingers around the eyepiece of the scope, and a textured exterior surface. The device includes a resilient first gasket disposed between the front collar and the plurality of front compression fingers. The device includes a rear collar removably connected to the rear end of the clamp tube to secure the body of the light assembly to the clamp tube within the open rear end of the clamp tube. The rear collar includes a fourth threaded region disposed on an interior surface to threadingly engage the third threaded region of the clamp tube and inwardly clamp the plurality of rear compression fingers around the body of the light assembly, and a textured exterior surface. The device includes a resilient second gasket disposed between the rear collar and the plurality of rear compression fingers. The light assembly projects illumination through the inner cavity and through the scope to form an illuminated image on a target. The illuminated image includes a representation of a crosshair of the scope. The body of the light assembly is linearly movable within the clamp tube. Movement of the body within the clamp tube positions the lamp relative to the eyepiece of the scope to focus the illumination projected through the inner cavity and the scope.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
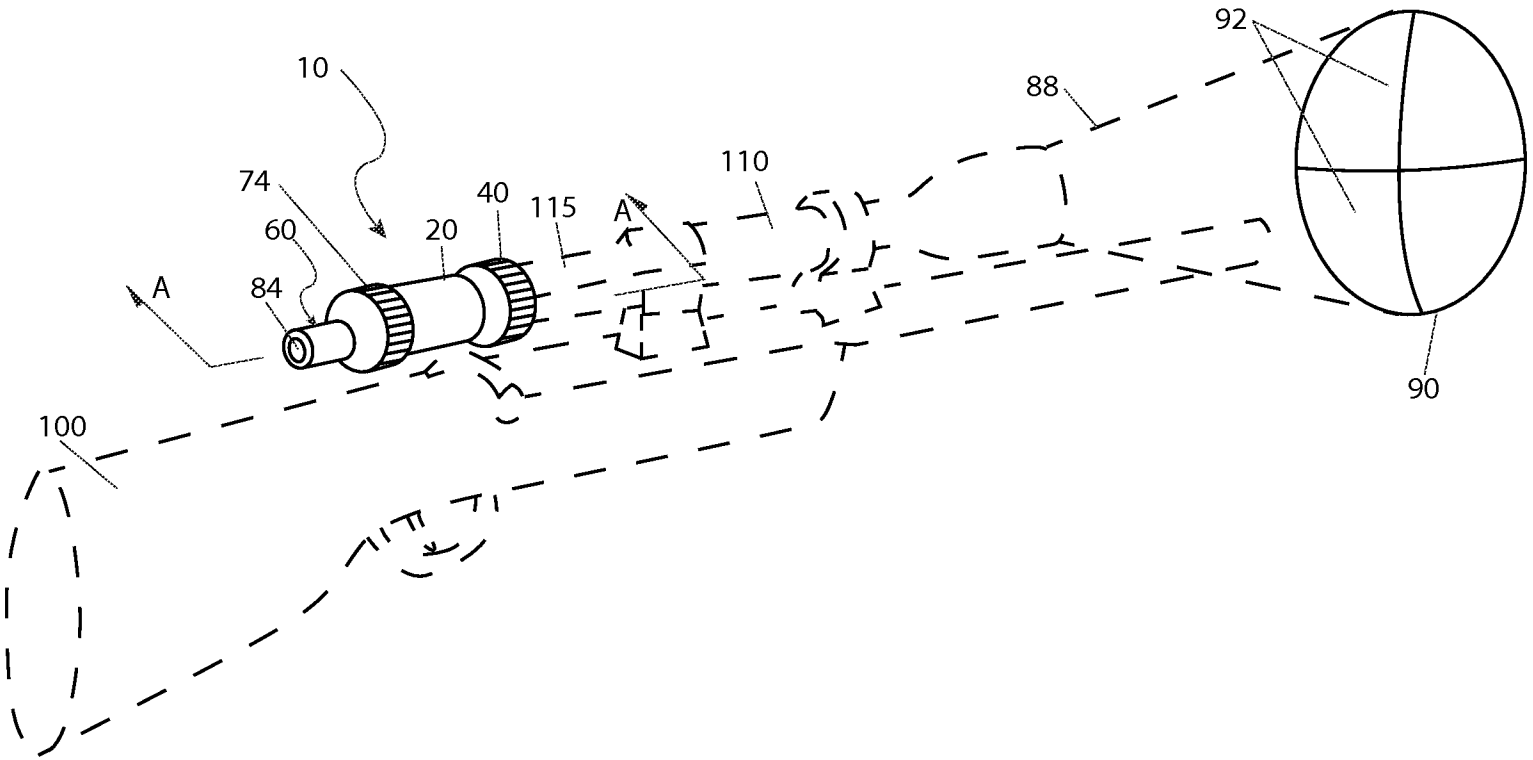
FIG. 1 is an environmental view of the disclosed illumination device for a rifle scope depicting attachment to a firearm, according to one (1) embodiment.

10 illumination device for a rifle scope
20 clamp tube
21 inner cavity
22*a* first threaded region
22*b* second threaded region
24 front compression finger
25 inner diameter
26 reflector
28 rear aperture
40 front collar
42 front aperture
44 textured surface
46 first gasket
60 light assembly
61 body
64 lamp
66 battery holder
68 battery
70 wiring
72*a* third threaded region
72*b* fourth threaded region
74 rear collar
75 rear compression finger
76 second gasket
80 switching cap
82 switch
84 button actuator
88 illumination
90 illuminated image
92 crosshair
100 firearm
110 scope
115 eyepiece

DETAILED DESCRIPTION OF THE PREFERRED EMBODIMENT

Figure 2:
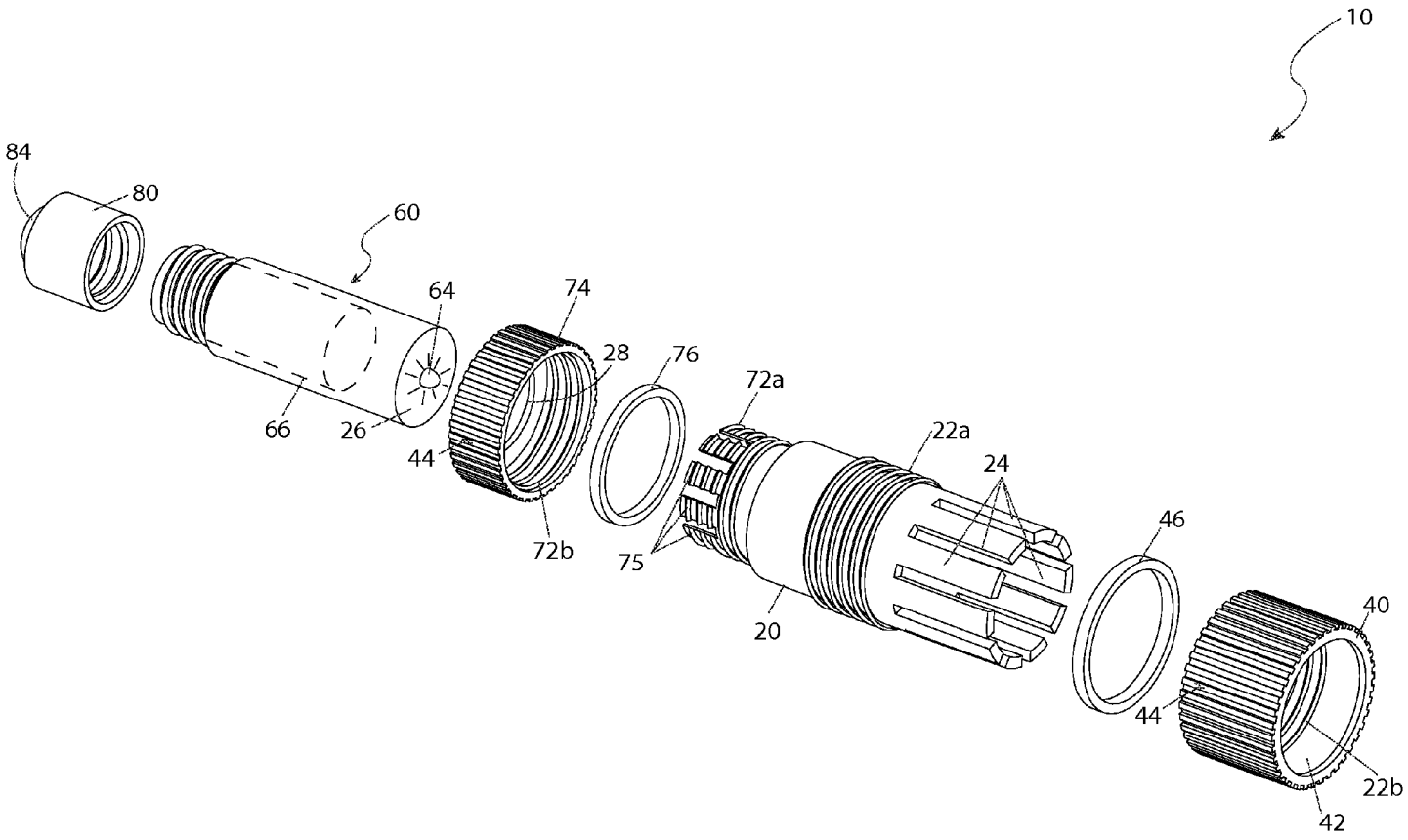
FIG. 2 is an exploded view of the illumination device of FIG. 1.
Figure 3:
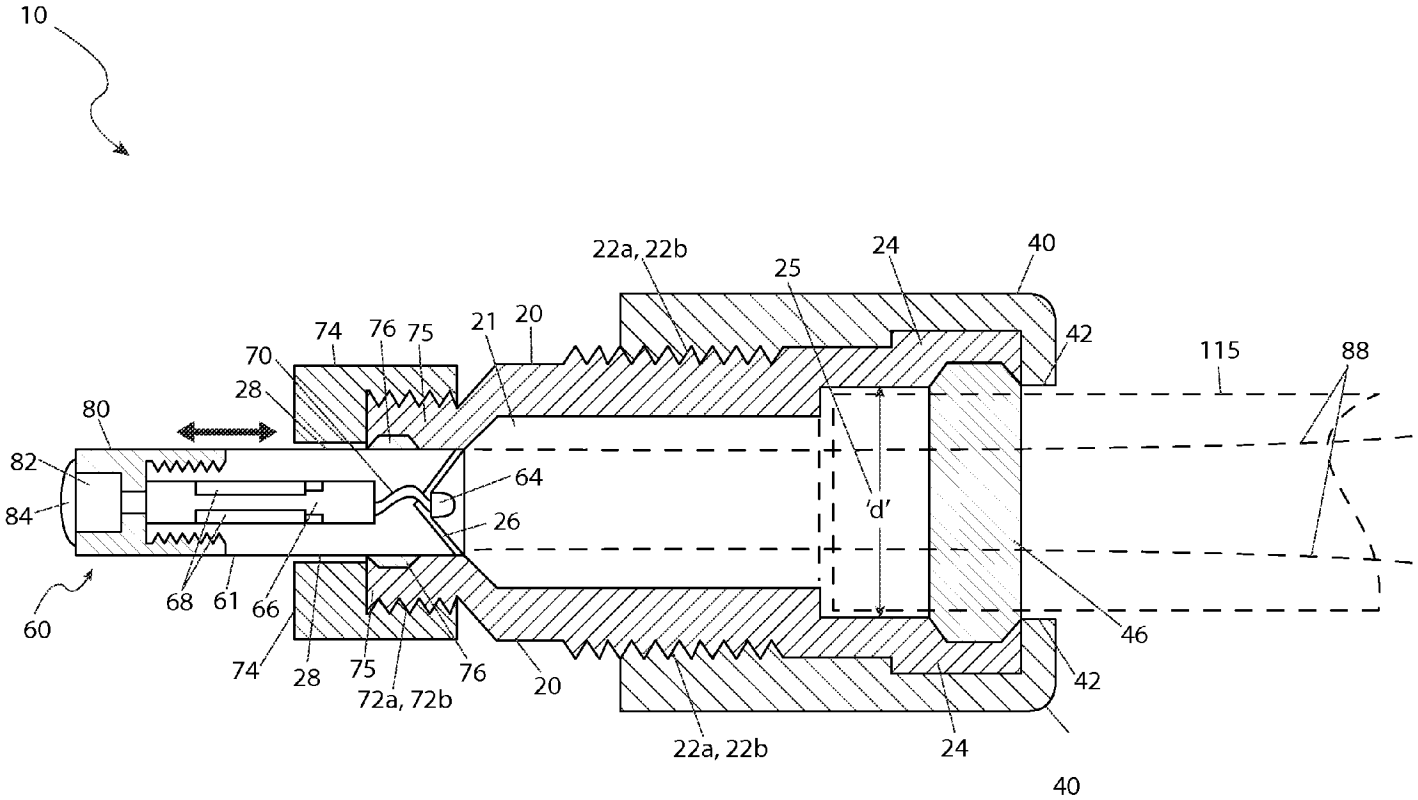
FIG. 3 is a sectional view of the illumination device taken along section line A-A of FIG. 1.

In accordance with the invention, the best mode is presented in terms of a one (1) or more of the disclosed embodiments, herein depicted within FIGS. 1 through 3. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-3, disclosing an illumination device (herein referred to as the "device") 10 for a telescopic sight (also referred to herein as a scope) of a firearm, where like reference numerals represent similar or like parts.

Referring to FIG. 1, the device 10 is configured to be mounted upon (e.g., mountable to) a firearm 100. The device 10 provides an enhanced illuminated hunting experience especially during low-light conditions (e.g., at dawn, dusk, or night). Generally, the device 10 utilizes illumination 88 from a light assembly 60, which works in combination with the sighting features of a scope 110 in a parallel fashion to project an illuminated image 90 through the scope 110.

In one embodiment, the device 10 includes a clamp tube 20, a front collar 40, a light assembly 60, a rear collar 74, and a switching cap 80. The device 10 is mounted to an eyepiece 115 of the scope 110. At least an end portion of the eyepiece 115 of the scope 110 is inserted through a front aperture 42 of the front collar 40 and into the clamp tube 20 and secured by a first gasket 46 acted upon by a plurality of internal compression fingers 24 (FIGS. 2 and 3) of the clamp tube 20. For example, the device 10 is secured directly to the eyepiece 115 of the scope 110 by a clamping (e.g., compression) force created by threading the front collar 40 onto the clamp tube 20.

The addition of the device 10 to the scope 110 allows a hunter to identify a crosshair 92 or similar aiming feature of the scope 110, which is illuminated and projected upon a target located at a distance of up to approximately one-hundred yards (100 yds.) away.

The clamp tube 20 and front collar 40 provide diametric adjustability to enable insertion and securement upon the eyepiece 115 of a variety of different types, styles, and sizes of scopes 110 such as those mounted to and used with firearms 100, for example, rifles, pistols, and the like.

In another embodiment, the device 10 is mounted to the firearm 100. For example, the device 10 is aligned with a front sight post (not shown) of the firearm 100. In such a configuration, the projected illumination 88 can be used to bore-site the firearm 100.

Referring to FIGS. 2 and 3, in one embodiment, the light assembly 60 includes a cylindrical body 61 containing a lamp 64 positioned within a conical (e.g., concave) reflector 26. The light assembly 60 is slidingly inserted into a rear aperture 28 of the rear collar 74. Linearly moving (e.g., sliding) the light assembly 60 into and out from the rear collar 74 focuses the illumination 88 (e.g., light) (FIG. 3) generated by the device 10 (e.g., the lamp 64) to produce a desired illuminated image 90 (FIG. 1). For example, the illuminated image 90 can form an illuminated circle projected upon the target containing the crosshair 92 (FIG. 1), another reticle feature of the scope 110, or the front sight post of the firearm 100.

In an example construction, exterior portions (e.g., housings) of the clamp tube 20, the front collar 40, the light assembly 60, and the rear collar 74 are be made of plastic or metal materials. In another example construction, the exterior portions are coated in black, camouflage, or other colors suitable for hunting.

Referring still to FIGS. 2 and 3, in one embodiment, the cylindrical clamp tube 20 includes a plurality of integral front compression fingers 24 disposed at a front end, an intermediate first threaded region 22*a* disposed at or near the front compression fingers 24, a plurality of integral rear compression fingers 75 disposed at a rear end, and a third threaded region 72*a* disposed at the rear compression fingers 75. The clamp tube 20 defines a hollow inner cavity 21.

In one (1) embodiment, the front compression fingers 24 are arranged in a circular manner around an opening of the inner cavity 21 at the front end. The plurality of front compression fingers 24 are parallel to one another. In one (1) example construction, the front compression fingers 24 are made of a flexible and semi-rigid (e.g., resilient) material, such as plastic.

The first threaded region 22*a* is inserted into the front collar 40 and threadingly engages a corresponding second threaded region 22*b* disposed on an interior of the front collar 40. As the first 22*a* and second 22*b* threaded regions are engaged, the front collar 40 acts upon the front compression fingers 24 and the circular rubber first gasket 46, thereby reducing an inner diameter 25 (FIG. 3) of the front compression fingers 24 and first gasket 46 tightly around the eyepiece 115 of the scope 110.

When the device 10 is mounted to the scope 110, the eyepiece 115 of the scope 110 extends outwardly from (e.g., in a forward direction) the front collar 40. The front collar 40 includes an external textured surface 44 (FIG. 2) which provides improved gripping to a user, for example, when threadingly engaging the front collar 40 to the clamp tube 20.

In one (1) example construction, the inner diameter 25 (FIG. 3) of the front compression fingers 24 and first gasket 46 are suitably sized fit upon (e.g., receive) a large number of different standard-sized scopes 110. However, those skilled in the art will recognize that the device 10 can include various inner diameters 25 of the front compression fingers 24 and first gasket 46 to fit non-standard eyepieces 115, and as such should not be interpreted as a limiting factor of the device 10.

In one embodiment, the rear compression fingers 75 and third threaded region 72*a* of the clamp tube 20 provide for attachment of the light assembly 60 to the clamp tube 20 in a similar manner as the described herein above for the attachment of the scope 110 to the clamp tube 20 (e.g., via engagement of the front compression fingers 24). For example, the rear compression fingers 75 together with a circular rubber second gasket 76 are compressed upon the cylindrical light assembly 60 by the rear collar 74 to secure the light assembly 60 at a desired position.

In one (1) example construction, the light assembly 60 is inserted into the rear aperture 28 of the rear collar 74 to allow illumination 88 to pass through the inner cavity 21 and through the scope 110 to produce the illuminated image 90 (FIG. 1). The rear collar 74 includes an external textured surface 44 (FIG. 2) to aid in gripping the rear collar 74, for example, while tightening the rear collar 74 onto the clamp tube 20. Threaded engagement of a fourth threaded region 72*b* on an interior of the rear collar 74 with the third threaded region 72*a* of the rear compression fingers 75 act to compress the rear compression fingers 75 and the contained second gasket 76 onto the light assembly 60.

In one (1) embodiment, the light assembly 60 includes the cylindrical body 61, the lamp 64, the conical reflector 26, a battery holder 66, and a threadingly attached switching cap 80. The lamp 64 produces the illumination 88 and the reflector 26 directs (e.g., reflects) the illumination 88 produced by the lamp 64. For example, when the light assembly 60 is moved longitudinally relative to the clamp tube 20 and the rear collar 74, it produces a desired size and intensity of the illuminated image 90. In one (1) embodiment, the lamp 64 includes one or more light-emitting diodes (LED). In another embodiment, the lamp 64 includes an incandescent bulb or other lamp-illumination technology. A user can vary an appearance of the illumination 88 to create a desired illuminated image 90 by manually sliding the body 61 into and out of the rear aperture 28 of the rear collar 74.

Referring to FIG. 3, in one (1) embodiment, the lamp 64 is in electrical communication with a removable battery holder 66 within the body 61 via wiring 70, which is in turn in electrical communication with a switch 82 within the threadingly attached switching cap 80. The battery holder 66 secures and positions at least one (1) miniature rechargeable or disposable battery 68, such as "AA" size, "AAA" size, or equivalent. In one (1) embodiment, the switching cap 80 includes an internal switch 82 having an external rubber button actuator 84. For example, the switch 82 includes an alternating push-on/push-off type mechanism being conveniently activated by pressing the button actuator 84 located along a rear surface of the switching cap 80.

Those skilled in the art will recognize that other styles and configurations of the disclosed device 10 can be easily incorporated into the teachings of the present disclosure, and only particular configurations have been shown and described for purposes of clarity and disclosure and not by way of limitation of scope.

The disclosed embodiments of the device 10 can be utilized by the common user in a simple and effortless manner with little or no training. After initial purchase or acquisition of the device 10, it would be installed as illustrated in FIGS. 1 and 3.

One (1) embodiment of the disclosed method for installing and utilizing the device 10 includes the following steps: 1). procuring a model of the device 10 having a desired external coating and an inner diameter 25 suitable to fit an intended scope 110; 2). installing at least one (1) fresh battery 68 into the battery holder 66; 3). installing the battery holder 66 into the body 61 of the light assembly 60; 4). installing the switching cap 80 in a threading manner onto the body 61; 5). inserting the eyepiece 115 of the scope 110 through the front aperture portion 42 and into the first gasket 46; 6). engaging the first 22*a* and second 22*b* threaded regions of the respective clamp tube 20 and front collar 40; 7). rotating the front collar 40 until the front compression fingers 24 act upon the first gasket 46 to clamp the eyepiece 115 tightly; 8). inserting the body 61 of the light assembly 60 into the rear aperture 28 and through the second gasket 76, if not previously installed; 9). positioning the light assembly 60 longitudinally until obtaining a desired position; 10). securing the light assembly 60 in position by engaging the third 72*a* and fourth 74*b* threaded regions of the rear compression fingers 75 and rear collar 74; 11). rotating the rear collar 74 until the second gasket 76 is clamped tightly around the body 61 of the light assembly 60; 12). pressing upon the button actuator 84 of the switching cap 80 to activate the light assembly 60; 13). projecting an illuminated image 90 through the scope 110 upon a target; and 14). participating in hunting or similar activity.

In another embodiment, the device 10 includes a non-sliding fixed light assembly 60 without the adjustable sliding function.

Accordingly, a user of the disclosed device 10 may benefit from projection of the illuminated image 90 containing the crosshair 92 or other aiming feature on the target.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An illuminating device comprising:

a clamp tube comprising an open front end and an opposed open rear end and defining an inner cavity extending from said front end to said rear end;

a front collar removably connected to said front end of said clamp tube;

a light assembly receivably connected to said clamp tube at said rear end;

wherein said front collar is configured to receivably connect to an eyepiece of a scope of a firearm and compress said front end of said clamp tube around said eyepiece;

wherein said clamp tube comprises a plurality of front compression fingers extending outwardly from said front end, said front compression fingers move inwardly upon said eyepiece of said scope in response to connection of said front collar to said front end; and, wherein said light assembly projects illumination through said inner cavity and through said scope.

2. The device of claim 1, wherein said illumination projected through said inner cavity and said scope forms an illuminated image on a target.

3. The device of claim 2, wherein said illuminated image comprises a representation of a crosshair of said scope.

4. The device of claim 1, wherein said light assembly is linearly movable within said clamp tube to focus said illumination projected through said inner cavity and said scope.

5. The device of claim 1, further comprising a resilient first gasket disposed between said front collar and said plurality of front compression fingers.

6. The device of claim 1 further comprising a rear collar removably connected to said rear end of said clamp tube to secure said light assembly to said clamp tube.

7. The device of claim 6, wherein said rear collar is threadingly connected to said rear end of said clamp tube to compress said rear end of said clamp tube around said light assembly.

8. The device of claim 7, wherein said clamp tube comprises a plurality of rear compression fingers extending outwardly from said rear end, and wherein said rear compression fingers move inwardly upon said light assembly in response to connection of said rear collar to said rear end.

9. The device of claim 8, further comprising a resilient second gasket disposed between said rear collar and said plurality of rear compression fingers.

10. The device of claim 1, wherein said light assembly comprises:

a body comprising a front end received through said rear end of said clamp tube and an opposed rear end;

a conical reflector disposed at said front end of said body; and, a lamp positioned within said conical reflector.

11. The device of claim 10, wherein:

said lamp comprises at least one light emitting diode;

said body of said light assembly is linearly movable within said clamp tube, and, movement of said body positions said lamp relative to said eyepiece of said scope to focus said illumination projected through said inner cavity and said scope.

12. An illuminating device comprising:

a clamp tube comprising an open front end and an opposed open rear end and defining an inner cavity extending from said front end to said rear end;

a light assembly receivably connected to said clamp tube at said rear end;

a scope for a firearm receivably connected to said clamp tube at said front end, a front collar threadingly connected to said front end of said clamp tube to clamp said scope to said clamp tube within said front end; and, a rear collar threadingly connected to said rear end of said clamp tube to clamp said light assembly to said clamp tube within said rear end;

wherein said clamp tube comprises a plurality of front compression fingers extending outwardly from said front end and a plurality of rear compression fingers extending outwardly from said rear end;

wherein said front compression fingers clamp inwardly upon said scope in response to tightening said front collar to said front end of said clamp body;

wherein said rear compression fingers clamp inwardly upon said light assembly in response to ti hag said rear collar to said rear end; and, wherein said light assembly projects illumination through said inner cavity and through said scope to form an illuminated image on a target.

13. The device of claim 12, wherein said light assembly is linearly movable within said clamp tube to focus said illumination projected through said inner cavity and said scope.

14. The device of claim 12, wherein said light assembly comprises:

a body comprising a front end received through said rear end of said clamp tube and an opposed rear end;

a conical reflector disposed at said front end of said body; and, a lamp positioned within said conical reflector.

15. An illumination device comprising:

a cylindrical clamp tube comprising:

a cylindrical open front end;

an opposed cylindrical open rear end;

a cylindrical inner cavity defined from said front end to said rear end;

a plurality of front compression fingers extending outwardly from said open front end, said plurality of front compression fingers being parallel to one another and equally spaced apart;

a plurality of rear compression fingers extending outwardly from said open rear end, said plurality of rear compression fingers being parallel to one another and equally spaced apart;

a first threaded region disposed on an exterior of said clamp tube at said plurality of front compression fingers; and, a third threaded region disposed on an exterior of said plurality of rear compression fingers, said plurality of rear compression fingers and said open front end being configured to receive an eyepiece of a scope of a firearm;

a light assembly comprising:

a body comprising a front end received through said rear end of said clamp tube and an opposed rear end;

a conical reflector disposed at said front end of said body;

a lamp positioned within said conical reflector;

a power source disposed within said body; and, a switching cap connected to said rear end of said body to provide electrical communication between said lamp and said power source;

a front collar removably connected to said front end of said clamp tube to secure said scope to said clamp tube within said open front end of said clamp tube, said front collar comprising:

a second threaded region disposed on an interior surface to threadingly engage said first threaded region of said clamp tube and inwardly clamp said plurality of front compression fingers around said eyepiece of said scope; and, a textured exterior surface;

a resilient first gasket disposed between said front collar and said plurality of front compression fingers;

a rear collar removably connected to said rear end of said clamp tube to secure said body of said light assembly to said clamp tube within said open rear end of said clamp tube, said rear collar comprising:

a fourth threaded region disposed on an interior surface to threadingly engage said third threaded region of said clamp tube and inwardly clamp said plurality of rear compression fingers around said body of said light assembly; and, a textured exterior surface; and, a resilient second gasket disposed between said rear collar and said plurality of rear compression fingers;

wherein said light assembly projects illumination through said inner cavity and through said scope to form an illuminated image on a target, said illuminated image comprising a representation of a crosshair of said scope;

wherein said body of said light assembly is linearly movable within said clamp tube; and, wherein movement of said body within said clamp tube positions said lamp relative to said eyepiece of said scope to focus said illumination projected through said inner cavity and said scope.

* * * * *